United States Patent [19]

Thorne et al.

[11] 4,421,025

[45] Dec. 20, 1983

[54] SPRING MOUNTED TORSIONALLY RIGID PRINT HAMMER MECHANISM

[75] Inventors: William D. Thorne, Wake Forest; William A. Patterson, Durham, both of N.C.

[73] Assignee: International Business Machines Corporation, Armonk, N.Y.

[21] Appl. No.: 333,091

[22] Filed: Dec. 21, 1981

[51] Int. Cl.[3] ..... B41J 3/00

[52] U.S. Cl. ..... 101/93.04; 101/93.33; 101/93.48

[58] Field of Search ..... 101/93.02, 93.04, 93.05, 101/93.23, 93.32, 93.33, 93.34, 93.48; 400/124, 157.2; 335/258

[56] References Cited

U.S. PATENT DOCUMENTS

| | | | |
|---|---|---|---|
| 2,523,660 | 9/1950 | Hulstein | 335/258 X |
| 3,164,085 | 1/1965 | Hawkins | 101/93.33 |
| 3,568,593 | 3/1971 | Papadopoulas | 101/93.34 |
| 3,810,195 | 5/1974 | Kilroy et al. | 101/93.04 |
| 3,850,278 | 11/1974 | Mihm et al. | 400/124 |
| 3,919,933 | 11/1975 | Potter | 101/93.32 |
| 4,018,155 | 4/1977 | Cargill | 101/93.33 |
| 4,034,841 | 7/1977 | Ohyama et al. | 400/124 |
| 4,106,406 | 8/1978 | Angelichio et al. | 101/93.02 |
| 4,150,619 | 4/1979 | Hasler et al. | 101/93.33 |
| 4,157,873 | 6/1979 | Ito | 400/124 |
| 4,189,997 | 2/1980 | Nozaki et al. | 101/93.23 |
| 4,259,653 | 3/1981 | McGonigal | 400/124 |
| 4,285,603 | 8/1981 | Bernardis et al. | 400/124 |

FOREIGN PATENT DOCUMENTS

| | | | |
|---|---|---|---|
| 155775 | 12/1981 | Japan | 101/93.04 |

*Primary Examiner*—Paul T. Sewell
*Assistant Examiner*—John A. Weresh
*Attorney, Agent, or Firm*—Edward H. Duffield

[57] ABSTRACT

An improved print hammer and actuator mechanism therefor are described. The hammer mechanism comprises a solenoid plunger and push wire or push rod which is directly affixed to one end of the hammer. The opposite end of the hammer is flexibly or pivotably mounted by a spring. The spring is rigidly affixed to the bottom portion of the hammer. It is flexed or twisted to enable the hammer top portion to be deflected. A shock absorbing connector connects the push wire to the print hammer. The position of the solenoid plunger can be adjusted by adjustable abutments at either end of its throw. This adjusts the flight time and the impact force, as well as the relative rest position of the hammer face, since the push wire is firmly connected to both the plunger and to the top of the hammer mechanism. The shock absorbing connector between the end of the push wire and the hammer mechanism controls the amount of force applied at impact.

2 Claims, 4 Drawing Figures

FIG. 2
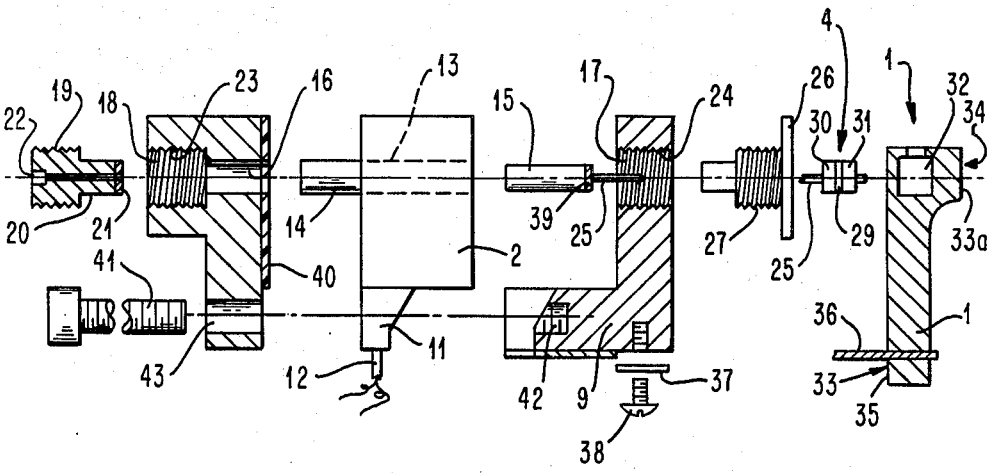
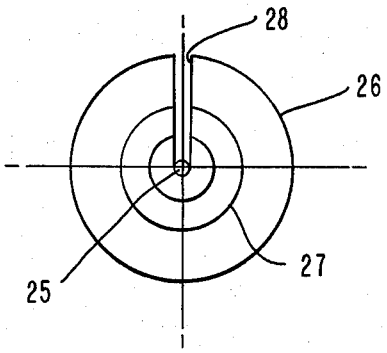
FIG. 3

SPRING MOUNTED TORSIONALLY RIGID PRINT HAMMER MECHANISM

FIELD OF THE INVENTION

This invention relates to impact printer mechanisms in general and specifically to impact hammer and driver mechanisms therefor intended for dot character or full engraved character impact printing machines.

PRIOR ART

A variety of impact hammer mechanisms exists in the known art. Most of the hammer mechanisms have a face having a width of only one or two characters. While hammers having extended widths spanning up to six or eight characters are known, these mechanisms are relatively expensive to build, are massive, and are difficult to drive at high speeds because of their size and mass. In addition, the great width of the hammer face creates torsional twisting moments that can cause variable force to be applied and the resultant variation in character intensity due to deflection of the hammer face.

In addition, most known hammer mechanisms of the type employed involve a flexed spring which supports the hammer at the bottom and allows the top of the hammer to be moved back and forth by application of magnetic forces. Designs exist in which the spring is cocked by a magnet and released by a bucking or counter electromagnetic field being applied. In such designs the impetus of the spring causes impact to occur.

Still other hammer mechanisms, chiefly those of the direct impact dot matrix style, are known to employ a plunger and wire with the end of the wire being the impact face itself. Such mechanisms may be magnetically driven and spring returned. This design requires application of energy to overcome the return spring force as will be appreciated by those of skill in the art. In addition, the width of the "hammer" is really only one dot diameter.

It is most desirable to have a hammer mechanism that can spin multiple character positions so as to reduce the cost of hammers and drivers therefor. However, elongating the width of a hammer face to cover more character positions along a print line requires that some means be provided for accurately adjusting all of the hammer faces to the same rest position. Adjustment for uniform flight and impact characteristics must also be made. And means to provide for torsional resistance to impacts near the extreme ends of the hammer face must be included since such impacts create great twisting moments about the center of mass of the hammer.

OBJECTS OF THE INVENTION

In light of the foregoing known difficulties in the prior art, it is an object of the present invention to provide an improved impact hammer and driver mechanism in which an elongated hammer face can be provided with great torsional twisting resistance and in which a direct mechanical drive is utilized that does not rely upon the flexed spring impact force means or upon electrical means or coil springs for return of the hammer.

Yet another object of the present invention is to provide an improved hammer driver in which easy external adjustment for hammer flight time, hammer face alignment and hammer impact force can be achieved.

Yet another object of the present invention is to provide an improved hammer assembly in which low mass, high torsional resistance hammers are firmly connected to the driver mechanism and means are provided for absorbing the shock of impact and/or for limiting the amount of impact force achieved.

SUMMARY

The foregoing and still other unenumerated objects of the present invention are met as provided in the preferred embodiment illustrated herein. A hammer frame of molded plastic having an integral hammer face which may also be of molded plastic or which may, in the alternative, have a molded metallic insert at impact face is utilized. The hammer is rigidly affixed to a flat, flexible leaf spring. When the impact end of the hammer is deflected by the driver means, the leaf spring flexes in a bending moment applied by action of the driver on the opposite end of the hammer. The bending moment applied to the flat leaf spring creates a restoring force so that when driving forces are removed, the hammer mechanism returns to its normal rest position. The driver mechanism comprises a rigid push rod which is firmly affixed to a solenoid plunger that rides in the hollow axial core of an electromagnetic coil. The plunger is positioned partly extended from the coil so that upon application of current to the coil the plunger is drawn inward toward the symmetrical center of the coil itself. Forces applied by the direct action of the moving plunger drive the rigid push wire or rod. The push wire is firmly affixed in approximate alignment with the impact face of the hammer to a position on the hammer near the opposite end from that in which the flexible leaf spring is firmly attached. The rest position of the plunger is adjusted by a simple screw abutment on the end portion of the coil and flux path assembly. It may be externally adjusted to align the hammer faces. It will be understood that the position of the plunger, rigidly connected through the push wire to the hammer, sets the rest position of the hammer faces.

The direct straight line movement of the plunger when the magnetic coil as energized is applied through the push rod directly in line with the impact face of the hammer. The position at which the plunger stops when energy is applied to the coil is adjusted by another screw abutment at the opposite end of the flux path member. This abutment provides the working air gap which determines the total flight time of the plunger. This is an air gap adjustment and provides a variation in the printing force as is well known to those of skill in the art.

The connection point between the push wire and the hammer is mounted in shock absorbing material. This is utilized to limit the total force applied by controlling the amount of impact force that can be applied to the hammer face by the moving plunger mechanism.

The hammers are of molded plastic and are molded in a framework design that imparts high torsional rigidity. The spring mounting affixed rigidly to the bottom end of the hammer framework is flexible in the plane of relative rotation of the hammer as it moves back and forth from actuated to unactuated position under the impetus of the plunger and push rod. The spring is very rigid in the torsional plane parallel to the print line (along the extended hammer face). Thus, torsional moments applied to the hammer face are met by a rigid compression or tension member at the base of the hammer rather than the usual flat flexible spring mounted in the vertical plane to flex back and forth in the same line as the hammer.

BRIEF DESCRIPTION OF THE DRAWINGS

The present invention will be illustrated and described with further reference to a preferred embodiment as shown in the attached drawings in which:

FIG. 2 illustrates a lateral cross-sectional view of a single hammer driver and hammer assembly showing details of construction and adjustment.

FIG. 3 illustrates an end view of screw 26.

DETAILED DESCRIPTION

Figure 1:
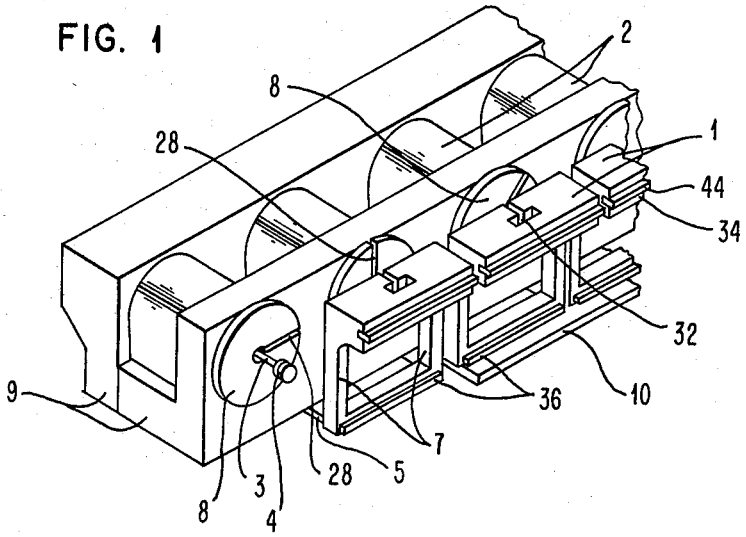
FIG. 1 illustrates a simplified pictorial view of the overall improved hammer driver and impact hammer assembly of the preferred embodiment of the invention.

Turning to FIG. 1, the overall view of a preferred embodiment of the hammer and driver mechanism of the present invention is shown. The hammer 1 is seen to have an impact face 34 in which a hard, wear-resistant metallic insert or the like may be included (shown as insert 44). In a preferred embodiment, the insert 44 is omitted, the hammer 1 being made of molded plastic having high strength and impact resistant properties and being highly rigid. The hammer 1 is integrally molded of plastic with frame members 7 which is rigidly attached at the bottom of the frame 6 to a flexible leaf spring or springs 5.

An electromagnetic coil 2 containing a solenoid plunger core (not shown) drives a push wire or push rod 3 which is connected through a connection means 4 to approximately the center of mass of the print hammer 1 in the center of the back face. One of the hammers in FIG. 1 has been removed for purposes of clarity to show the mechanism lying in back of the hammer.

A flight time adjustment and force adjustment screw 8 having a slot 28 to facilitate assembly is shown.

The magnetic path flux return members 9 are also the framework pieces. It may be easily seen that an entire bank of hammers, each hammer having a face 34 of multiple character widths, can be quickly and easily assembled.

The leaf spring 5 flexes as bending moments are applied due to deflection of the hammer face outward under impetus of the push rod 3 driven by the solenoid plunger, not shown, when the coil 2 is energized. The bending moment about the flexible spring 5 is applied to the bottom portion of the frame 6. The reaction moment due to bending the spring 5 tends to restore the plunger (not shown) and push rod 3 when current on coil 2 is removed.

The overall rigid frame assembly 8 may be secured to a connector card 10 through which electronic control signals and driving currents may be applied as will be more apparent in other figures.

Turning to FIG. 2, an exploded view of a single hammer station for a hammer and driver assembly is shown. A hammer 1 having an impact end 33 and a mounting end 35 is shown in horizontal section. The line of action of the drive forces is directly aligned with the impact face 34 on hammer 1 and includes the elements as follows.

The electromagnetic coil 2 has a hollow core 13 in which is mounted a non-magnetic, preferably self-lubricating, plastic sleeve 14. A magnetic plunger 15 of iron or the like is slidably received within the aperture in the hollow core 13 so that the plunger may move laterally under the action of the magnetic field created when current is applied to the coil 2. Current is supplied to coil 2 through electrical leads 12 which are firmly held by strain relief molding of plastic or rubber 11. Plunger 15 is normally positioned off the central axis of the coil out of the center of symmetry thereof so that it may be drawn inward upon application of current through leads 12. The plunger partly extends into the axial bore 16 in the frame member and flux return path member 9 at rest position.

The bore 16 communicates with the enlarged passage 18 bearing threads 23 in which the hammer face adjustment screw 19 is received. The adjustment screw 19 is threaded as shown and has a reduced diameter portion 20 that is slidably received in bore 16. The end face 21 is faced with a plastic impact-absorbing and residual magnetic flux path interrupting layer to prevent metal-to-metal contact and to absorb impact. Metal-to-metal contact needs to be reduced or eliminated in magnetic structures of this type so that residual magnetism of the plunger 15 will not cause it to adhere to the screw 19. Screw 19 has a central bore 22 that communicates from the outside to the bore 16 to allow air that is entrapped there to escape when plunger 15 moves toward screw 19.

The L-shaped portion of the frame and flux member 9 is shown to the right of the coil 2 in FIG. 2. This member also has an axial bore 17 that is directly aligned with bores 13 and 16 in the coil and in the other frame member and flux piece 9, respectively. The bore 17 is provided with threads 24 that cooperate with the threads 27 on the flight time and impact force adjustment and abutment screw 26. A push rod or wire 25 is rigidly affixed to plunger 15 and to the termination or head 29 integrally formed with or welded on push rod 25. Push rod 25 has been shown broken in FIG. 2 for purposes of clarity but it will be understood that 25 is one continuous solid piece.

The end of plunger 15 is faced with plastic material 39 to prevent metal-to-metal impact and contact and also to act as a residual flux interrupter. The end surface of the abutment and flight time adjustment screw 26 may impact against residual member 39. This controls the working air gap between the end of the plunger 15 and the end of the screw 26 as will be apparent.

The push rod or push wire 25 terminating in the head portion 29 is sandwiched between two rubber shock absorbing force-limiting members 30 and 31 as shown. These members are compressed and inserted within a cavity 32 in the hammer 1 where they are allowed to expand to firmly lock the driving end of the push wire 25 in engagement with the head end 33 of hammer 1.

The overall adjustment in operation of the driver mechanism may now be understood. The hammer face 34 is first adjusted to be in alignment with all adjacent hammer faces (not shown) by the adjusting screw 19 which positions plunger 15 at some point within the axial bore 16, 13, 17 of the assembly. The push rod 25 rigidly joins the plunger 15 to the hammer 1 and the spring 36 creates a return moment of hammer 1 about its firm attachment point 33 to the spring 36 as shown. Spring 36 is rigidly affixed to the bottom of frame member 9 by means of a clamping plate 37 and a screw 38, for example. Any deflection of hammer 1 towards the right at the top end 33*a* in FIG. 2 will create a bending moment on the spring 36 which will be restored as soon as driving forces are removed. This will tend to drive push rod 25 and plunger 15 back toward the left in FIG. 2 to the rest position in abutment with the residual flux interruptor and abutment plate 21 on the end of screw 19.

The working gap between the end face residual portion 39 and the end of screw 26 is adjusted by means of screw threads 27 and 24 by turning screw 26. A slot 28 shown in FIG. 3 and visible in FIG. 1 allows the screw 26 to be slid over the push rod or push wire 25 and then screwed into the bore 17. The slot may also be used to provide a shake-proof screw thread either by including an insert or by allowing a slight difference in diameter for a tight compression fit as is well known with slotted screw fasteners.

Adjusting the position of screw 26 sets the air gap between the end of the plunger 15, where the impact and residual magnetic interruptor 39 facing material is placed, and the end of the screw 26. This can be utilized to control the amount of force and the total flight time of the hammer as follows:

Coil 2 is pulsed and screw 26 is adjusted until a given flight time measured by a forced transducer (not shown) is achieved. The total air gap employed can be such that the hammer face 34 may impact a character-forming member (not shown) and come to a stop before the face of plunger 15 contacts the end of the screw 26. Under such circumstances, the rubber shock absorber portion 31 will compress at the rate determined by the durometer and type of material employed. This will be chosen to be a rate sufficient to cause printing of characters up to some maximum size or which is the maximum impact force desired. As will be appreciated by those of skill in the art, harder rubber shock absorber 31 will allow the imposition of greater impact forces while softer materials will reduce the amount of force applied.

If reduced forces are required from the same mechanism for printing different fonts, etc., the air gap can be adjusted as previously described in such a fashion that the impact and magnetic flux terminator 39 will impact the end of screw 26 prior to the time that the hammer face 34 strikes the character. This will cause the rubber absorber 30 trapped in cavity 32 to be compressed which will absorb some of the printing force.

The overall result is that the rubber shock absorbing mount 30 and 31 can be employed to create a maximized limit to the printing forces. This allows for application of different amounts of coil energies to coil 2 to cause an acceptable printing stroke. This feature allows for greater power supply and magnetic circuit variations for creating acceptable print force than other hammer designs. It also permits a variation in the hammer firing repetition rate by applying pulses and voltage controls to the coil 2. It also permits changing the gap for fixed hammer repetition rates to accommodate different coil and power supply idiosyncrasies.

Stopping of the plunger 15 by impact against the screw 26 can absorb kinetic energy of the plunger and wire assembly and reduce the total print energy supplied. In the preferred embodiment shown, approximately one-third of the total kinetic energy can be removed in this fashion. The rubber force reducer or shock absorber 30 and 31 will be compressed during additional travel of the hammer assembly and the resultant energy will be sufficient to print characters of the desired intensity and/or size without penetrating the paper and the ribbon. Penetration occurs when print forces are too great for the area of the character being printed as is well known in the art and can be greatly alleviated by this design.

One of the great advantages of the present design is that it can be employed for various hammer widths. The push wire 25 can be adjusted in length to allow for numerous hammers to be placed in tight confinement by having their coils staggered in horizontal fashion to overlap one another. Therefore, coils that are wider than the hammer face can be employed since they may be placed further back from the hammer by elongating the push wire 25. Shorter assemblies can then be sandwiched between longer ones to achieve tight packing.

A further advantage in the present design is that the wide face of the hammer 1 allows for a span of multiple character positions. The high strength plastic molding of the hammer 1 allows for great torsional rigidity as does its means of connection to the flexural spring support 36. It will be noted that spring 36 lies in a plane generally perpendicular to the hammer length measured between end 33 and end 35 and is parallel to the general position of the hammer face and print line. Therefore, torsional moments created by impact at either extreme of the hammer face widths will be translated through the rigid frame of the hammer 1 to the spring 36 but will apply compressive or tensile forces, not bending forces. These forces will be easily accommodated and absorbed without significant torsional deflection of the hammer face.

The push rod and plunger assembly can be arranged to drive preferably through the center of mass of the hammer to further take advantage of the torsional rigidity. The hammer itself being driven through the shock-absorbing connection to the push rod 25 and being supplied with the adjusting screws 26 and 19 can be used for long periods of time since the resultant wear on the hammer can be closely controlled by limiting the impact forces. The ease of adjusting the total flight and impact characteristics of the hammer and the simple construction lends itself to modular assemblies where the entire frame member 9, which may be of iron or other magnetic material, can extruded or molded in a single piece. Normally, the frame member 9 will be at least in two pieces as shown in FIG. 2 to account for various widths of coil 2.

On assembly, a rubber gasket 40 may be employed between the face of the coil 2 and one of the frame members 9 to take up tolerance variations in the length of the coil 2. This prevents coil 2 from moving back and forth between the frame members 9. A screw 41 inserted through axial bore 43 and cooperating with a threaded bore 42 in frame piece 9 rigidly clamps the coil 2 between the frame members 9. Frame members 9 must connect or contact each other to complete the magnetic flux path circuit from the coil 2 as will be appreciated by those skilled in the art. Similarly, the screw 26 may be made of magnetic material so that the flux path from the end face of coil 2 through the frame member 9 where the axial hole 17 appears can be maintained.

FIG. 3 illustrates an end view of the screw 26 showing the slot 28 which allows the push rod or wire 25 to slip down into proper position so that screw 26 can be inserted in the axial bore 17 in frame piece 9 upon assembly.

Figure 4:
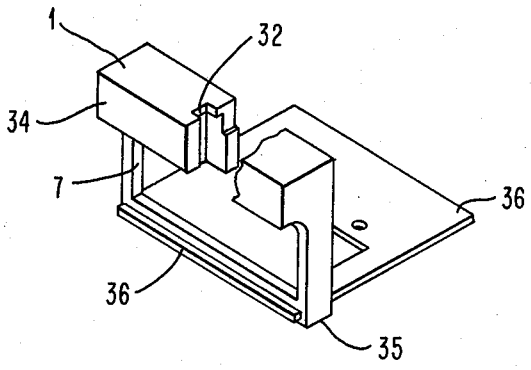
FIG. 4 illustrates details of the hammer and spring assembly.

FIG. 4 illustrates the details of the hammer and spring assembly.

In FIG. 4, the spring 36 is rigidly affixed to the bottom portion of the hammer at position 35. The hammer 1 has integrally molded rigid frame members 7 and a T-shaped slot 32 into which the connector 29, 30 and 31 is assembled. The slot of the T-shape allows the push wire 25 to be inserted as will be apparent. The impact face 34 of hammer 1 can be the same material as the rest of the hammer, namely, an injection-molded high-strength plastic, or it can have a metallic insert molded in place or affixed thereto if desired. FIG. 1 illustrates such an insert as an alternative wear-resistant surface 44.

It will be appreciated that the present design supplies the print driving forces directly through the center of mass of the hammer and avoids the use of flexed spring energy means for driving the hammers. The adjustment screws 19 and 26 provide accurate means for aligning the faces of adjacent hammers to the same print line and also provide an easy means of precise control of the hammer flight time and impact forces for each individual driver. The overall simplicity of structure enables an entire bank of hammers necessary for a full printing line width of any given machine to be easily constructed. The frame members 9 can be of sufficient length to accommodate whatever number of hammers and drivers is desired.

Having thus described my invention with reference to a preferred embodiment thereof, many modifications in the specific design and implementation will be apparent to those of skill in the art. Therefore, what is described in the following claims is intended to be by way of representation rather than limitation.

Wherefore, what is claimed is:

1. A printing hammer and driver mechanism for impact printers, comprising:

an electromagnetic coil having a hollow axial core;

a magnetic plunger slidably received within said hollow axial core;

a magnetic flux path member connecting the ends of said hollow core on said electromagnetic coil and completing a flux path from one end of said coil to the other, said flux path member having apertures coaxially aligned with said hollow core;

a push wire;

said push wire being connected to one end of said plunger and extending outwardly therefrom through said hollow core and through one of said apertures in said flux path member;

said push wire having a termination means on the end thereof opposite to said plunger;

a print hammer;

said hammer having an impact face spanning a plurality of impact positions along a print line proximate to one end of said hammer;

a single flexible spring hammer support and restoring element proximate the other end of said hammer having a width in the direction of said print line approximately as great as that of said impact face of said hammer measured to said print line parallel said spring lying in a plane parallel to said print line and spaced from said print line by a distance substantially equal to the distance between said impact face and said other end of said hammer, said hammer having an axis which is perpendicular to both said one end and said other end, said spring being perpendicular to said axis said flexible spring having two ends, one end being anchored and the other end thereof being rigidly affixed to said hammer to support said hammer's weight and to resiliently restore said hammer towards its retracted position;

said push wire being connected through said termination means to said hammer at a position along said axis thereof which is removed from the point thereon where said flexible spring is attached thereto;

said plunger being positioned in said hollow core of said electromagnet and resiliently biased away from the symmetrical center thereof by said flexible spring forcing said hammer and attached push wire in a direction to exert force on said push wire to position said plunger; and said plunger being drawn toward the symmetrical center of said core upon application of electrical current thereto to force said push wire and hammer in the opposite direction to that urged by said spring.

2. Apparatus as described in claim 1 and further comprising:

a resilient shock absorbing means connected to said termination means on said push wire and to said hammer for absorbing forces applied by said push wire to said hammer.

* * * * *